US011570571B2

(12) United States Patent
Lee et al.

(10) Patent No.: US 11,570,571 B2
(45) Date of Patent: Jan. 31, 2023

(54) METHOD AND APPARATUS FOR PERFORMING BINAURAL RENDERING OF AUDIO SIGNAL

(71) Applicant: Electronics and Telecommunications Research Institute, Daejeon (KR)

(72) Inventors: Yong Ju Lee, Daejeon (KR); Jae-hyoun Yoo, Daejeon (KR); Mi Suk Lee, Daejeon (KR); Kyeongok Kang, Daejeon (KR); Dae Young Jang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 17/199,757

(22) Filed: Mar. 12, 2021

(65) Prior Publication Data

US 2022/0014869 A1 Jan. 13, 2022

(30) Foreign Application Priority Data

Jul. 9, 2020 (KR) ..... 10-2020-0084518

(51) Int. Cl.
*H04S 7/00* (2006.01)
*G10L 19/008* (2013.01)
*H04S 3/00* (2006.01)

(52) U.S. Cl.
CPC ..... *H04S 7/307* (2013.01); *G10L 19/008* (2013.01); *H04S 3/004* (2013.01); *H04S 3/008* (2013.01); *H04S 7/302* (2013.01)

(58) Field of Classification Search
CPC ..... H04S 7/307; H04S 3/004; H04S 3/008; H04S 7/302; G10L 19/008
USPC ..... 381/98
See application file for complete search history.

(56) References Cited

U.S. PATENT DOCUMENTS 5,946,400 A * 8/1999 Matsuo ..... H04S 1/005 381/1
9,319,819 B2 4/2016 Lee et al.
2003/0220602 A1* 11/2003 Lynch ..... A61M 25/0068 604/8
2003/0223602 A1* 12/2003 Eichler ..... H04S 3/004 381/74

(Continued)

FOREIGN PATENT DOCUMENTS

KR 1020190028706 A 3/2019
KR 1020190091445 A 8/2019
WO 2015011055 A1 1/2015

*Primary Examiner* — Vivian C Chin
*Assistant Examiner* — Douglas J Suthers
(74) *Attorney, Agent, or Firm* — William Park & Associates Ltd.

(57) ABSTRACT

A method and apparatus for performing binaural rendering of an audio signal are provided. The method includes identifying an input signal that is based on an object, and metadata that includes distance information indicating a distance to the object, generating a binaural filter that is based on the metadata, using a binaural room impulse response, obtaining a binaural filter to which a low-pass filter (LPF) is applied, using a frequency response control that is based on the distance information, and generating a binaural-rendered output signal by performing a convolution of the input signal and the binaural filter to which the LPF is applied.

5 Claims, 8 Drawing Sheets

(56) References Cited

U.S. PATENT DOCUMENTS

2016/0227338 A1* 8/2016 Oh ..... H04S 7/303
2016/0277865 A1 9/2016 Lee et al.

* cited by examiner

METHOD AND APPARATUS FOR PERFORMING BINAURAL RENDERING OF AUDIO SIGNAL

CROSS-REFERENCE TO RELATED APPLICATION(S)

This application claims the benefit of Korean Patent Application No. 10-2020-0084518, filed on Jul. 9, 2020, in the Korean Intellectual Property Office, the disclosure of which is incorporated herein by reference.

BACKGROUND

1. Field of the Invention

One or more example embodiments relate to a method and apparatus for performing rendering of an audio signal, and more particularly, a method and apparatus for performing binaural rendering on an object-based audio signal based on an attenuation rate according to a distance for each frequency.

2. Description of the Related Art

Audio-related services have changed from mono and stereo services to multi-channel services such as 9.1, 11.1, 10.2, 13.1, 15.1, and 22.2 channels including upstream channels, through 5.1 and 7.1 channel services. Unlike existing channel services, an object-based audio-related service that regards one sound source as an object and that stores, transmits, and/or reproduces information such as a position and magnitude of an audio signal generated from the sound source has also been developed.

A magnitude of an audio signal transferred to a listener changes based on a distance between a sound source and the listener. For example, generally, an audio signal transferred to a listener at a distance of 2 meters (m) from an audio source is less than an audio signal transferred to a listener at a distance of 1 m from the audio source. Theoretically, in a free field environment, a magnitude of an audio signal decreases in inverse proportion to a distance. When a distance between a sound source and a listener is doubled, an audio signal audible by the listener decreases by 6 decibels (dB).

Here, a degree to which the audio signal is attenuated according to the distance may be determined based on frequencies. The related document ([Blauert, J. (1976)], "Spatial Hearing" (Revised Edition), The MIT Press) discloses that an attenuation rate of a low frequency is less than that of a high frequency at a distance of 15 m or greater.

However, since such an attenuation rate may be defined differently according to an environment, it is difficult to mathematically express the attenuation rate. Accordingly, the existing technology has an issue in that attenuation rates for each frequency are not considered during binaural rendering of an audio signal.

SUMMARY

Example embodiments provide a method and apparatus for performing binaural rendering of an audio signal, to generate a more realistic audio signal based on an attenuation rate according to a distance for each frequency.

According to an aspect, there is provided a binaural rendering method including identifying metadata and an input signal that is based on an object, the metadata including distance information indicating a distance to the object, generating a binaural filter that is based on the metadata, using a binaural room impulse response, obtaining a binaural filter to which a low-pass filter (LPF) is applied, using a frequency response control that is based on the distance information, and generating a binaural-rendered output signal by performing a convolution of the input signal and the binaural filter to which the LPF is applied.

The LPF may have a cutoff frequency. The cutoff frequency may decrease as the distance to the object based on the distance information increases.

The LPF may have a cutoff frequency. The cutoff frequency may have the same value when the distance to the object based on the distance information is less than or equal to a threshold. The cutoff frequency may decrease as the distance to the object based on the distance information increases, when the distance to the object based on the distance information is greater than the threshold.

According to another aspect, there is provided a binaural rendering method including identifying metadata and an input signal that is based on an object, the metadata including distance information indicating a distance to the object, generating a binaural filter that is based on the metadata, using a binaural room impulse response; obtaining an input signal to which an LPF is applied, using a frequency response control that is based on the distance information, and generating a binaural-rendered output signal by performing a convolution of the binaural filter and the input signal to which the LPF is applied.

The LPF may have a cutoff frequency. The cutoff frequency may decrease as the distance to the object based on the distance information increases.

The LPF may have a cutoff frequency. The cutoff frequency may have the same value when the distance to the object based on the distance information is less than or equal to a threshold. The cutoff frequency may decrease as the distance to the object based on the distance information increases, when the distance to the object based on the distance information is greater than the threshold.

According to another aspect, there is provided a binaural rendering method including identifying metadata and an input signal that is based on an object, the metadata including distance information indicating a distance to the object, generating a binaural filter that is based on the metadata, using a binaural room impulse response, determining a binaural-rendered input signal by performing a convolution of the input signal and the binaural filter, and generating an output signal to which an LPF is applied from the binaural-rendered input signal, using a frequency response control that is based on the distance information.

The LPF may have a cutoff frequency. The cutoff frequency may decrease as the distance to the object based on the distance information increases.

The LPF may have a cutoff frequency. The cutoff frequency may have the same value when the distance to the object based on the distance information is less than or equal to a threshold. The cutoff frequency may decrease as the distance to the object based on the distance information increases, when the distance to the object based on the distance information is greater than the threshold.

According to another aspect, there is provided a binaural rendering method including identifying metadata and an input signal that is based on an object, the metadata including distance information indicating a distance to the object, determining a binaural filter to which an LPF is applied, using a binaural room impulse response that is based on the metadata and a frequency response control that is based on the distance information, and generating a binaural-rendered output signal by performing a convolution of the input signal and the binaural filter to which the LPF is applied.

The LPF may have a cutoff frequency. The cutoff frequency may decrease as the distance to the object based on the distance information increases.

The LPF may have a cutoff frequency. The cutoff frequency may have the same value when the distance to the object based on the distance information is less than or equal to a threshold. The cutoff frequency may decrease as the distance to the object based on the distance information increases, when the distance to the object based on the distance information is greater than the threshold.

According to another aspect, there is provided a binaural rendering apparatus including a processor, wherein the processor is configured to identify metadata and an input signal that is based on an object, the metadata including distance information indicating a distance to the object, to generate a binaural filter that is based on the metadata, using a binaural room impulse response, to obtain a binaural filter to which an LPF is applied, using a frequency response control that is based on the distance information, and to generate a binaural-rendered output signal by performing a convolution of the input signal and the binaural filter to which the LPF is applied.

The LPF may have a cutoff frequency. The cutoff frequency may decrease as the distance to the object based on the distance information increases.

According to another aspect, there is provided a binaural rendering apparatus including a processor, wherein the processor is configured to identify metadata and an input signal that is based on an object, the metadata including distance information indicating a distance to the object, to generate a binaural filter that is based on the metadata, using a binaural room impulse response, to obtain an input signal to which an LPF is applied, using a frequency response control that is based on the distance information, and to generate a binaural-rendered output signal by performing a convolution of the binaural filter and the input signal to which the LPF is applied.

The LPF may have a cutoff frequency. The cutoff frequency may decrease as the distance to the object based on the distance information increases.

According to another aspect, there is provided a binaural rendering apparatus including a processor, wherein the processor is configured to identify metadata and an input signal that is based on an object, the metadata including distance information indicating a distance to the object, to generate a binaural filter that is based on the metadata, using a binaural room impulse response, to determine a binaural-rendered input signal by performing a convolution of the input signal and the binaural filter, and to generate an output signal to which an LPF is applied from the binaural-rendered input signal, using a frequency response control that is based on the distance information.

The LPF may have a cutoff frequency. The cutoff frequency may decrease as the distance to the object based on the distance information increases.

According to another aspect, there is provided a binaural rendering apparatus including a processor, wherein the processor is configured to identify metadata and an input signal that is based on an object, the metadata including distance information indicating a distance to the object, to determine a binaural filter to which an LPF is applied, using a binaural room impulse response that is based on the metadata and a frequency response control that is based on the distance information, and to generate a binaural-rendered output signal by performing a convolution of the input signal and the binaural filter to which the LPF is applied.

The LPF may have a cutoff frequency. The cutoff frequency may decrease as the distance to the object based on the distance information increases.

Additional aspects of example embodiments will be set forth in part in the description which follows and, in part, will be apparent from the description, or may be learned by practice of the disclosure.

According to example embodiments, it is possible to generate a more realistic audio signal based on an attenuation rate according to a distance for each frequency by performing binaural rendering of an audio signal.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
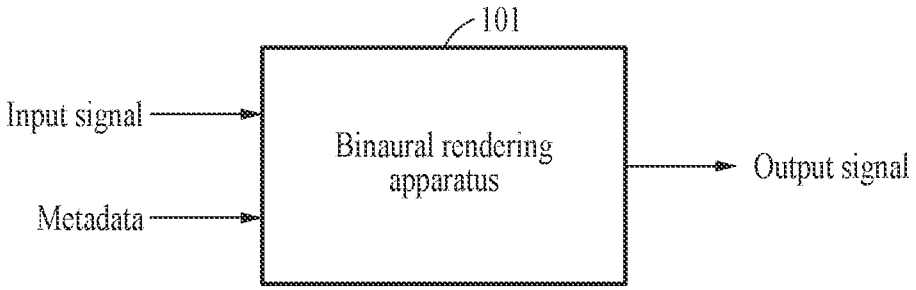
FIG. 1 is a diagram illustrating a binaural rendering apparatus according to an example embodiment.

Hereinafter, some example embodiments will be described in detail with reference to the accompanying drawings. However, various alterations and modifications may be made to the example embodiments. Here, the example embodiments are not construed as limited to the disclosure and should be understood to include all changes, equivalents, and replacements within the idea and the technical scope of the disclosure.

The terminology used herein is for the purpose of describing particular example embodiments only and is not to be limiting of the example embodiments. As used herein, the singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Unless otherwise defined, all terms including technical and scientific terms used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

When describing the example embodiments with reference to the accompanying drawings, like reference numerals refer to like constituent elements and a repeated description related thereto will be omitted. In the description of example embodiments, detailed description of well-known related technologies will be omitted when it is deemed that such description will cause ambiguous interpretation of the present disclosure.

FIG. 1 is a diagram illustrating a binaural rendering apparatus according to an example embodiment.

In the present disclosure, binaural rendering of an audio signal may be performed using a frequency response control that is based on distance information of the audio signal. The binaural rendering may reflect an attenuation rate of a magnitude of the audio signal. A binaural rendering apparatus 101 for performing a binaural rendering method according to an example embodiment may correspond to a processor.

Referring to FIG. 1, the binaural rendering apparatus 101 may identify an input signal and metadata, and may generate a binaural-rendered output signal based on the input signal and the metadata. For example, the input signal may correspond to an object-based audio signal, and the metadata may be information about features of an object. The metadata may include, for example, position information indicating a position of an object in a three-dimensional (3D) space, distance information indicating a distance between a listener and an object, or gain information indicating a gain of an object. However, the metadata is not limited to the examples described above, and may include other information.

In the present disclosure, a binaural rendering process may be performed by performing a convolution of an object-based audio signal and a binaural filter determined based on metadata of an audio signal. The binaural filter may refer to a binaural room impulse response filter. The binaural rendering apparatus 101 may generate a binaural filter that is based on metadata, using a binaural room impulse response.

The binaural rendering apparatus 101 may select one binaural filter from binaural filters that are generated in advance, based on position information and distance information in the metadata, or may generate a new binaural filter. A type or an implementation of binaural filters is not limited to a specific example.

The binaural rendering apparatus 101 may generate a binaural-rendered output signal, by applying a low-pass filter (LPF) to an input signal, an output signal, or a binaural filter, using a frequency response control that is based on the distance information of the metadata.

FIGS. 2A to 2D are diagrams illustrating various examples of a binaural rendering method according to an example embodiment. An LPF may be an independent filter and may be executed independently of other filters. Thus, LPFs may be applied at various positions of a binaural rendering apparatus, which will be described below with reference to FIGS. 2A to 2D.

Figure 2A:
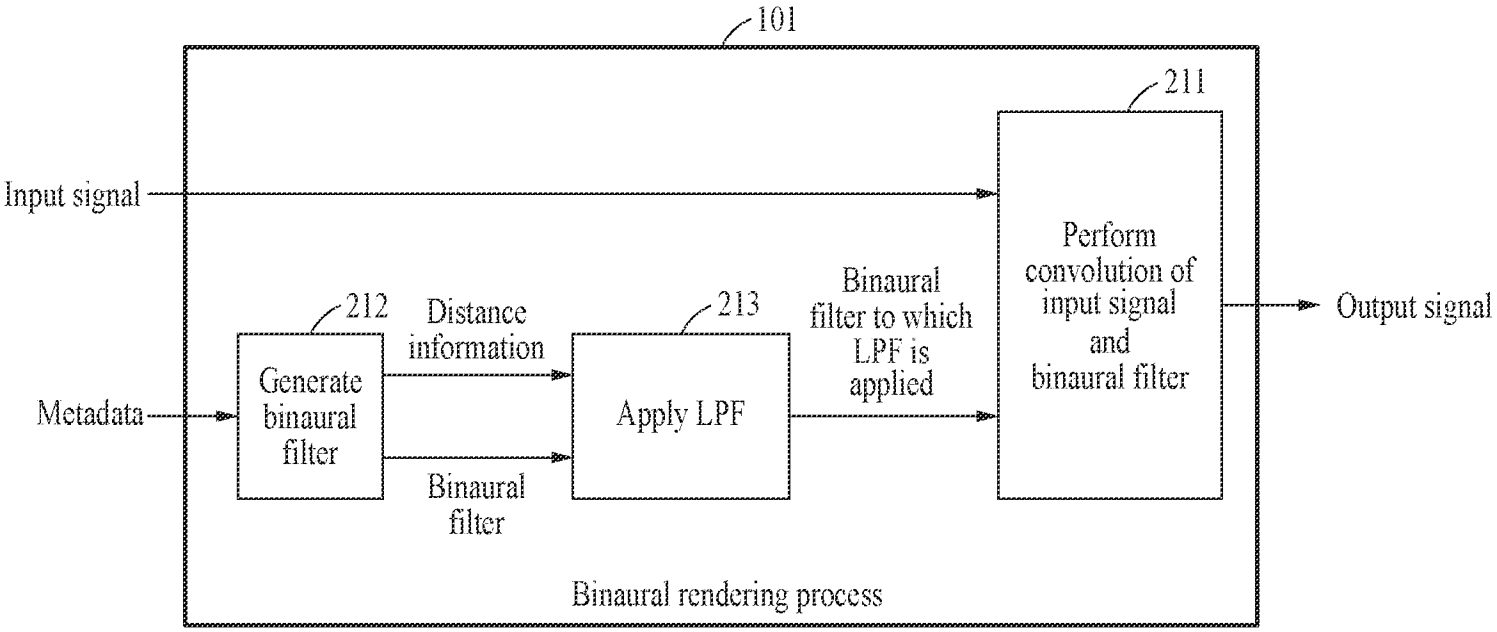
FIGS. 2A to 2D are diagrams illustrating various examples of a binaural rendering method according to an example embodiment.
Figure 2B:
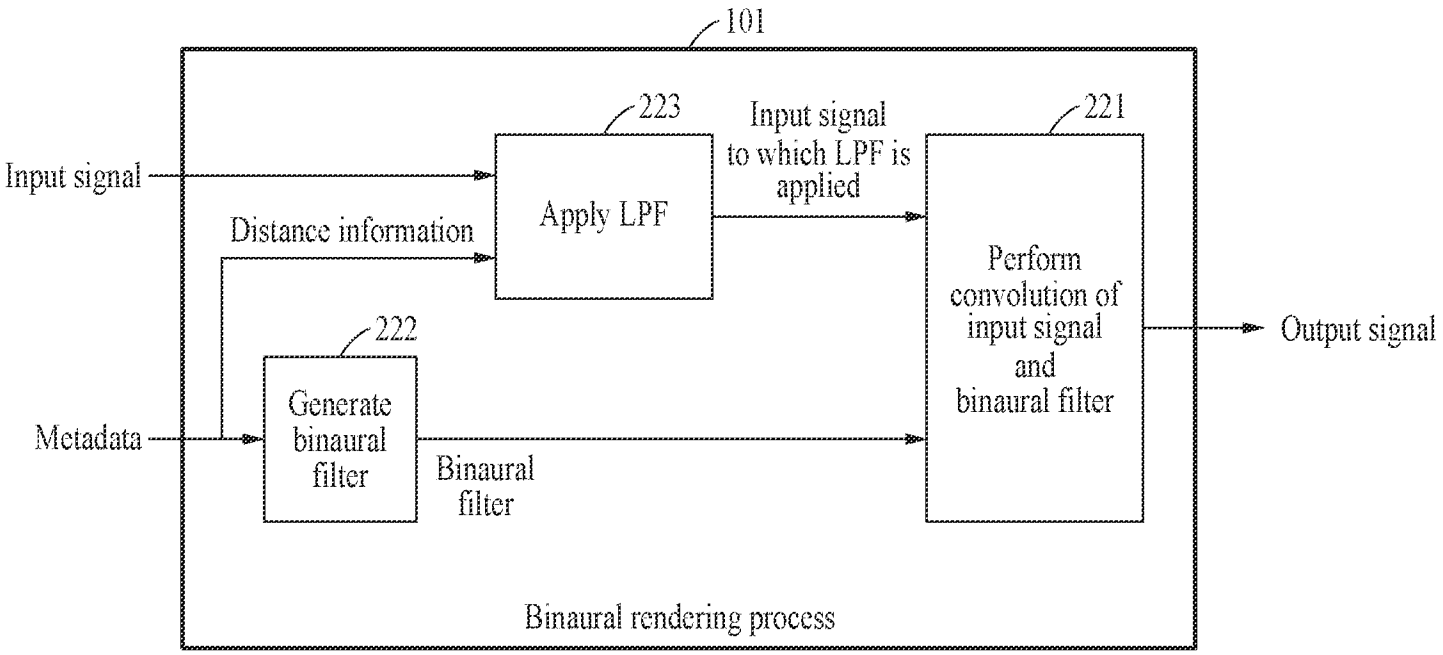
Figure 2C:
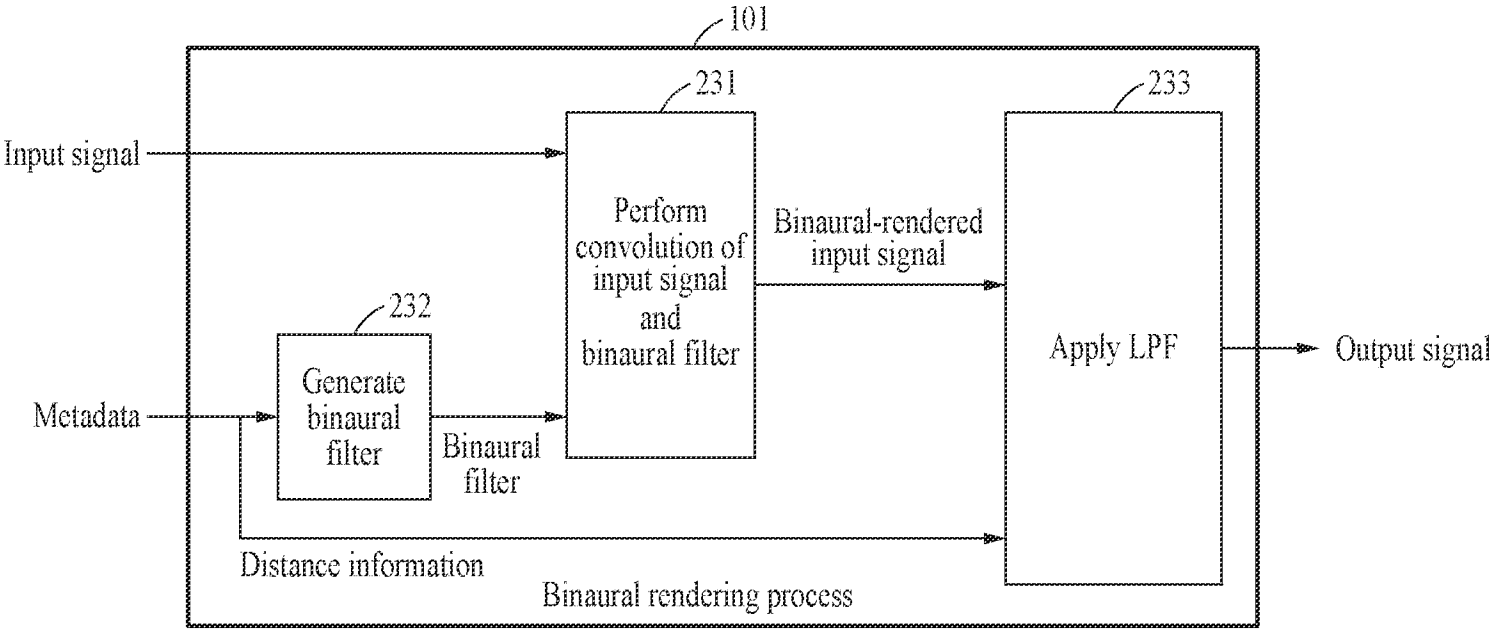
Figure 2D:
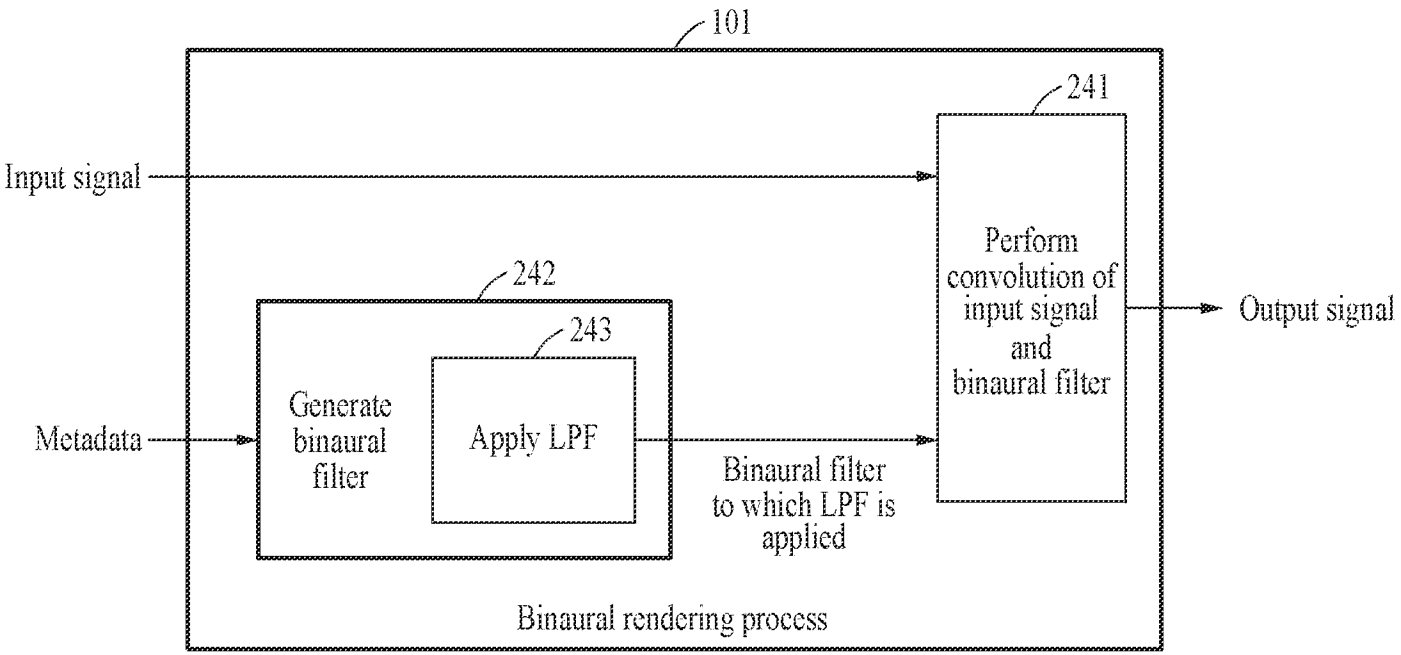

FIG. 2A illustrates an example of applying an LPF to a binaural filter, and FIG. 2B illustrates an example of applying an LPF to an input signal. FIG. 2C illustrates an example of applying an LPF to a binaural-rendered signal, and FIG. 2D illustrates an example of applying an LPF in a process of generating a binaural filter. The examples may show the same effect although LPFs are applied to different positions.

FIGS. 2A to 2D illustrate binaural rendering processes performed in a binaural rendering apparatus 101. To reflect an attenuation rate of a magnitude of an audio signal according to a distance for each frequency, the binaural rendering apparatus 101 may apply an LPF to an input signal, an output signal, or a binaural filter, using a frequency response control that is based on distance information of metadata.

For example, the binaural rendering apparatus 101 may determine a cutoff frequency of an LPF based on the distance information of the metadata, to perform a frequency response control. In other words, the frequency response control may refer to an operation of filtering an audio signal based on a cutoff frequency, and the LPF may refer to a filter used for filtering based on the cutoff frequency.

A process of performing binaural rendering using a frequency response control in the present disclosure may be performed as one of an example of performing binaural rendering by applying an LPF to a binaural filter, an example of performing binaural rendering by applying an LPF to an input signal, an example of performing binaural rendering by applying an LPF to a binaural-rendered input signal, and an example of performing binaural rendering by applying an LPF in a process of determining a binaural filter.

Specifically, FIG. 2A illustrates a process of performing binaural rendering by applying an LPF to a binaural filter determined based on metadata.

In operation 212, the binaural rendering apparatus 101 may generate a binaural filter that is based on metadata, using a binaural room impulse response. In operation 213, the binaural rendering apparatus 101 may apply an LPF to the generated binaural filter and distance information of the metadata.

Specifically, the binaural rendering apparatus 101 may determine a cutoff frequency of the LPF for a frequency response control, based on the distance information of the metadata, and may apply the LPF to the binaural filter based on the determined cutoff frequency, to generate a binaural filter to which the LPF is applied.

In operation 211, the binaural rendering apparatus 101 may perform a convolution of an input signal and the binaural filter to which the LPF is applied, to generate a binaural-rendered output signal. The binaural rendering apparatus 101 may generate an output signal filtered according to the frequency of the LPF, using the binaural filter to which the LPF is applied.

FIG. 2B illustrates a process of performing binaural rendering by applying an LPF to an input signal.

In operation 222, the binaural rendering apparatus 101 may generate a binaural filter that is based on metadata, using a binaural room impulse response. In operation 223, the binaural rendering apparatus 101 may determine an input signal to which an LPF is applied, using a frequency response control that is based on distance information of the metadata.

Specifically, in operation 233, the binaural rendering apparatus 101 may determine a cutoff frequency of the LPF for a frequency response control, based on the distance information of the metadata, and may perform filtering on the binaural-rendered input signal according to the determined cutoff frequency, to generate an output signal to which the LPF is applied. In other words, the input signal to which the LPF is applied may refer to an input signal filtered according to the cutoff frequency of the LPF.

In operation 221, the binaural rendering apparatus 101 may perform a convolution of the binaural filter and the input signal to which the LPF is applied, to generate a binaural-rendered output signal.

FIG. 2C illustrates a process of performing binaural rendering by applying an LPF to a binaural-rendered input signal.

In operation 232, the binaural rendering apparatus 101 may generate a binaural filter that is based on metadata, using a binaural room impulse response. In operation 231, the binaural rendering apparatus 101 may perform a convolution of the binaural filter and an input signal, to generate a binaural-rendered input signal.

In operation 231, the binaural rendering apparatus 101 may extract an output signal to which the LPF is applied from the binaural-rendered input signal, using a frequency response control that is based on distance information of the metadata.

Specifically, the binaural rendering apparatus 101 may determine a cutoff frequency of the LPF for a frequency response control, based on the distance information of the metadata, and may perform filtering on the binaural-rendered input signal according to the determined cutoff frequency, to generate an output signal to which the LPF is applied.

FIG. 2D illustrates a process of performing binaural rendering by applying an LPF in a process of determining a binaural filter.

In operation 242, the binaural rendering apparatus 101 may generate a binaural filter that is based on metadata, using a binaural room impulse response. In operation 243, the binaural rendering apparatus 101 may apply an LPF determined based on distance information of the metadata to the binaural filter.

Specifically, the binaural rendering apparatus 101 may determine a cutoff frequency of the LPF for a frequency response control, based on the distance information of the metadata, and may generate a binaural filter capable of performing filtering according to the determined cutoff frequency.

In operation 241, the binaural rendering apparatus 101 may perform a convolution of an input signal and the binaural filter to which the LPF is applied, to generate a binaural-rendered output signal.

Figure 3A:
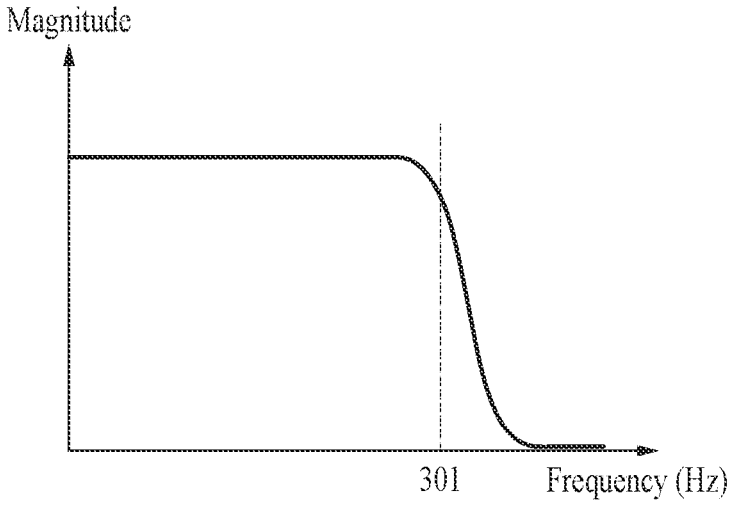
FIGS. 3A to 3C are graphs illustrating examples of a cutoff frequency based on a distance according to an example embodiment.
Figure 3B:
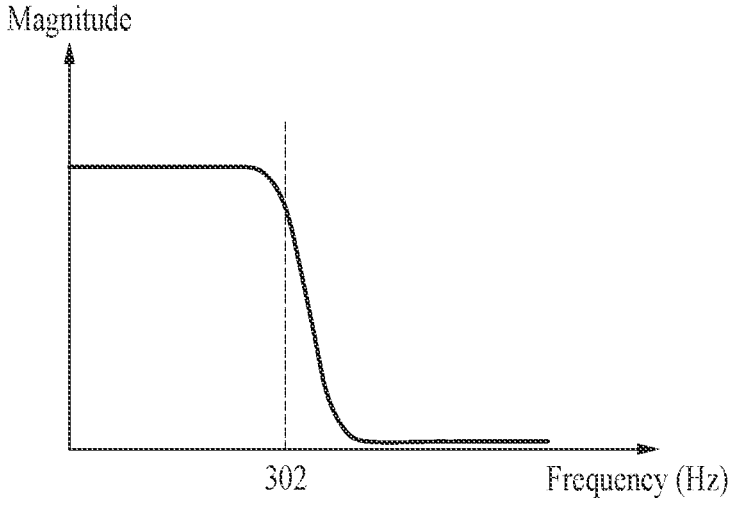
Figure 3C:
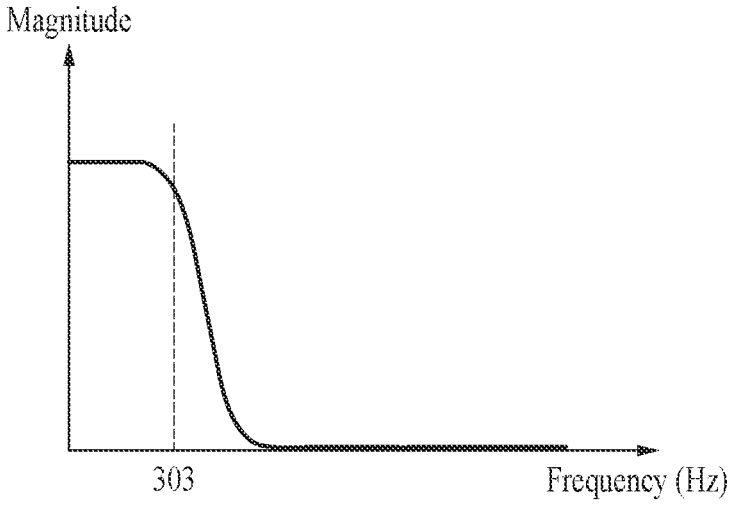

FIGS. 3A to 3C are graphs illustrating examples of a cutoff frequency based on a distance according to an example embodiment.

A binaural rendering apparatus may determine a cutoff frequency of an LPF based on distance information to apply the LPF in using a frequency response control. In an example, when a distance to an object increases, a cutoff frequency may be determined to decrease by the binaural rendering apparatus. In another example, when the distance to the object decreases, the cutoff frequency may be determined to increase.

When a distance to an object based on distance information increases, a value of a cutoff frequency may decrease. When the distance to the object decreases, the value of the cutoff frequency may increase. The binaural rendering apparatus may determine, in advance, a relationship between the cutoff frequency and the distance to the object, and may determine the cutoff frequency according to distance information of metadata, using the determined relationship.

The relationship between the cutoff frequency and the distance to the object may be determined using various schemes. For example, the cutoff frequency and the distance to the object may be in a linear relationship, and the cutoff frequency may be determined to have the same value regardless of the distance, in a specific distance interval. The relationship between the cutoff frequency and the distance to the object will be further described below with reference to FIGS. 4A and 4B.

In FIGS. 3A to 3C, the cutoff frequency is determined to decrease when the distance of the object increases, in applying an LPF for a frequency response control. In each of the graphs of FIGS. 3A to 3C, a horizontal axis represents a frequency of an input signal, and a vertical axis represents a magnitude of the input signal.

In an example of FIG. 3A, a distance to an object is less than those of examples of FIGS. 3B and 3C. In FIG. 3A, a cutoff frequency 301 may be determined to be greater than a cutoff frequency 302 of FIG. 3B and a cutoff frequency 303 of FIG. 3C.

In an example of FIG. 3C, a distance to an object is greater than those of examples of FIGS. 3A and 3B. In FIG. 3C, the cutoff frequency 303 may be determined to be less than the cutoff frequency 301 of FIG. 3A and the cutoff frequency 302 of FIG. 3B.

Figure 4A:
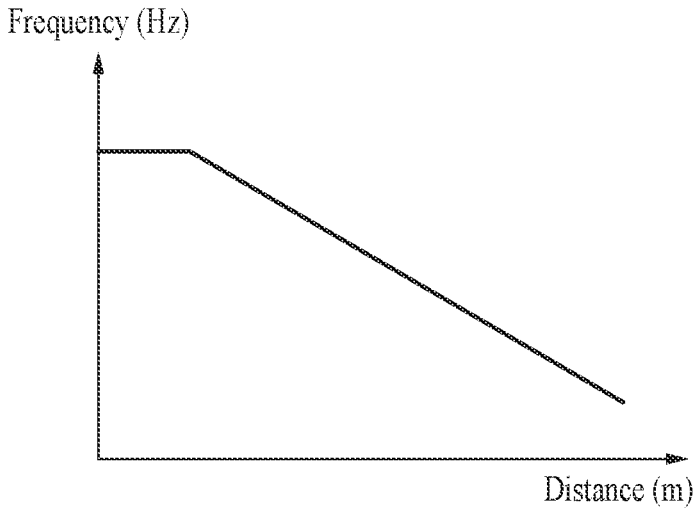
FIGS. 4A and 4B are graphs illustrating examples of a portion of relationships between a cutoff frequency and a distance according to an example embodiment.
Figure 4B:
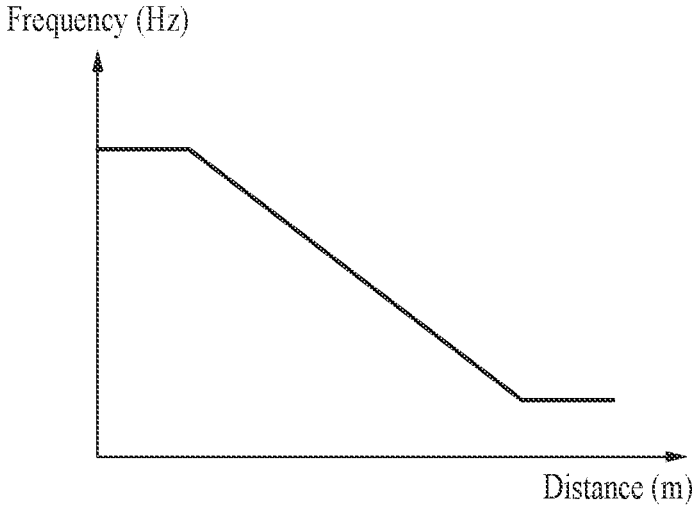

FIGS. 4A and 4B are graphs illustrating examples of a portion of relationships between a cutoff frequency and a distance to an object according to an example embodiment.

In each of the graphs of FIGS. 4A and 4B, a horizontal axis represents a distance to an object, and a vertical axis represents a cutoff frequency. In an example of FIG. 4A, when the distance to the object is less than or equal to a threshold, the cutoff frequency may be determined to have the same value. In this example, when the distance to the object exceeds the threshold, the cutoff frequency may be determined based on a linear function with a negative slope.

The above relationship between the cutoff frequency and the distance to the object is not limited to a form of the linear function. In another example, in FIG. 4A, when the distance to the object exceeds the threshold, the relationship may be in a form of a monotone decreasing function, for example, at least a two-dimensional curve. In this example, when the distance to the object exceeds the threshold, the cutoff frequency may be determined based on the monotone decreasing function.

When the distance to the object is less than or equal to the threshold, the cutoff frequency may decrease with a constant slope as the distance increases, instead of being determined to have the same value.

In an example of FIG. 4B, two thresholds may be determined in advance. When a distance to an object is less than a lower threshold of the two thresholds or is greater than the other threshold, a cutoff frequency may be determined to have the same value. When the distance to the object has a value between the two thresholds, the cutoff frequency may be determined based on a linear function with a negative slope.

As described above, the relationship between the cutoff frequency and the distance to the object is not limited to the above examples. In an example, a plurality of thresholds may be determined in advance, and a cutoff frequency for a distance to an object may be determined based on functions with different types of slopes for each distance interval determined by the plurality of thresholds.

Thus, various types of functions that satisfy a condition that a cutoff frequency is less than a previous cutoff frequency when a distance to an object increases may correspond to a relationship between the cutoff frequency and the distance to the object.

The method according to example embodiments may be embodied as a program that is executable by a computer and may be implemented as various recording media such as a magnetic storage medium, an optical reading medium, and a digital storage medium.

The components described in the example embodiments may be implemented by hardware components including, for example, at least one digital signal processor (DSP), a processor, a controller, an application-specific integrated circuit (ASIC), a programmable logic element, such as a field programmable gate array (FPGA), other electronic devices, or combinations thereof. At least some of the functions or the processes described in the example embodiments may be implemented by software, and the software may be recorded on a recording medium. The components, the functions, and the processes described in the example embodiments may be implemented by a combination of hardware and software.

Various techniques described herein may be implemented in digital electronic circuitry, computer hardware, firmware, software, or combinations thereof. The techniques may be implemented as a computer program product, i.e., a computer program tangibly embodied in a machine-readable storage device (for example, a computer-readable medium) or in a propagated signal, for processing by, or to control an operation of, a data processing apparatus, e.g., a programmable processor, a computer, or multiple computers. A computer program, such as the computer program(s) described above, may be written in any form of a programming language, including compiled or interpreted languages, and may be deployed in any form, including as a stand-alone program or as a module, a component, a subroutine, or other units suitable for use in a computing environment. A computer program may be deployed to be processed on one computer or multiple computers at one site or distributed across multiple sites and interconnected by a communication network.

Processors suitable for processing of a computer program include, by way of example, both general and special purpose microprocessors, and any one or more processors of any kind of digital computer. Generally, a processor will receive instructions and data from a read-only memory or a random-access memory, or both. Elements of a computer may include at least one processor for executing instructions and one or more memory devices for storing instructions and data. Generally, a computer also may include, or be operatively coupled to receive data from or transfer data to, or both, one or more mass storage devices for storing data, e.g., magnetic, magneto-optical disks, or optical disks. Examples of information carriers suitable for embodying computer program instructions and data include semiconductor memory devices, e.g., magnetic media such as hard disks, floppy disks, and magnetic tape, optical media such as a compact disk read-only memory (CD-ROM) or digital video disks (DVDs), magneto-optical media such as floptical disks, read-only memory (ROM), random-access memory (RAM), flash memory, erasable programmable ROM (EPROM), or electrically erasable programmable ROM (EEPROM). The processor and the memory may be supplemented by, or incorporated in special purpose logic circuitry.

In addition, non-transitory computer-readable media may be any available media that may be accessed by a computer and may include all computer storage media.

The present specification includes details of a number of specific implements, but it should be understood that the details do not limit any invention or what is claimable in the specification but rather describe features of the specific example embodiment. Features described in the specification in the context of individual example embodiments may be implemented as a combination in a single example embodiment. In contrast, various features described in the specification in the context of a single example embodiment may be implemented in multiple example embodiments individually or in an appropriate sub-combination. Furthermore, the features may operate in a specific combination and may be initially described as claimed in the combination, but one or more features may be excluded from the claimed combination in some cases, and the claimed combination may be changed into a sub-combination or a modification of a sub-combination.

Similarly, even though operations are described in a specific order on the drawings, it should not be understood as the operations needing to be performed in the specific order or in sequence to obtain desired results or as all the operations needing to be performed. In a specific case, multitasking and parallel processing may be advantageous. In addition, it should not be understood as requiring a separation of various apparatus components in the above-described example embodiments in all example embodiments, and it should be understood that the above-described program components and apparatuses may be incorporated into a single software product or may be packaged in multiple software products.

It should be understood that example embodiments disclosed herein are merely illustrative and are not intended to limit the scope of the disclosure. It will be apparent to those skilled in the art that various modifications of the example embodiments may be made without departing from the spirit and scope of the claims and their equivalents.

What is claimed is:

1. A rendering method comprising:

identifying an object-based audio signal;

identifying metadata including distance information representing the distance between an object corresponding to the object-based audio signal and a listener; and rendering the object-based audio signal, based on the distance information representing the distance between an object corresponding to the object-based audio signal and a listener, wherein, the object-based audio signal is rendered as an effect of applying a low-pass filter (LPF) according to the distance information included in the metadata, wherein rendering the object-based audio signal comprises:

determining a binaural filter that is based on the metadata, using a binaural room impulse response;

obtaining the binaural filter to which the low-pass filter (LPF) is applied, using a frequency response control that is based on the distance information; and generating a binaural-rendered output signal by performing a convolution of the object-based audio signal and the binaural filter which the low-pass filter (LPF) has been applied.

2. The rendering method of claim 1, wherein the LPF has a cutoff frequency, and the cutoff frequency decreases as the distance represented by the distance information increases.

3. The rendering method of claim 1, wherein:

the LPF has a cutoff frequency, the cutoff frequency has a predetermined value when the distance represented by the distance information is less than or equal to a threshold, and the cutoff frequency decreases as the distance represented by the distance information increases, when the distance represented by the distance information is greater than the threshold.

4. A rendering method comprising:

identifying an object-based audio signal;

identifying metadata including distance information representing the distance between an object corresponding to the object-based audio signal and a listener; and rendering the object-based audio signal, based on the distance information representing the distance between an object corresponding to the object-based audio signal and a listener, wherein, the object-based audio signal is rendered as an effect of applying a low-pass filter (LPF) according to the distance information included in the metadata, wherein rendering the object-based audio signal comprises:

determining a binaural filter that is based on the metadata, using a binaural room impulse response;

obtaining an input signal to which a low-pass filter (LPF) is applied, using a frequency response control that is based on the distance information; and generating a binaural-rendered output signal by performing a convolution of the binaural filter and the input signal to which the LPF has been applied, wherein the LPF has a cutoff frequency, wherein the cutoff frequency has a predetermined value when the distance represented by the distance information is less than or equal to a threshold, and wherein the cutoff frequency decreases as the distance represented by the distance information increases, when the distance represented by the distance information is greater than the threshold.

5. A rendering method comprising:

identifying an object-based audio signal;

identifying metadata including distance information representing the distance between an object corresponding to the object-based audio signal and a listener; and rendering the object-based audio signal, based on the distance information representing the distance between an object corresponding to the object-based audio signal and a listener, wherein, the object-based audio signal is rendered as an effect of applying a low-pass filter (LPF) according to the distance information included in the metadata, wherein the rendering the object-based audio signal comprises:

determining a binaural filter that is based on the metadata, using a binaural room impulse response;

generating a binaural-rendered input signal by performing a convolution of the input signal and the binaural filter; and extracting an output signal in which a low-pass filter (LPF) is applied to the binaural-rendered input signal, using a frequency response control that is based on the distance information, wherein the LPF has a cutoff frequency, wherein the cutoff frequency has a predetermined value when the distance represented by the distance information is less than or equal to a threshold, and wherein the cutoff frequency decreases as the distance represented by the distance information increases, when the distance represented by the distance information is greater than the threshold.

* * * * *